US006061856A

United States Patent [19]

Hoffmann

[11] Patent Number: 6,061,856

[45] Date of Patent: May 16, 2000

[54] MATTRESS

[76] Inventor: Hubert Hoffmann, Weingarten 7, D-85283 Wolnzach, Germany

[21] Appl. No.: 09/187,704

[22] Filed: Nov. 6, 1998

[30] Foreign Application Priority Data

Mar. 22, 1998 [DE] Germany ..... 198 12 382

[51] Int. Cl.[7] ..... A47C 27/15; A47C 27/18

[52] U.S. Cl. ..... 5/728; 5/724; 5/706

[58] Field of Search ..... 5/728, 727, 729, 5/730, 724, 722, 723, 706, 707, 710

[56] References Cited

U.S. PATENT DOCUMENTS

| | | | |
|---|---|---|---|
| 1,446,290 | 2/1923 | Dessau | 5/728 |
| 4,161,045 | 7/1979 | Regan | 5/728 |
| 5,533,218 | 7/1996 | Fahy | 5/727 |

FOREIGN PATENT DOCUMENTS

| | | | |
|---|---|---|---|
| 0637426 | 2/1995 | European Pat. Off. . | |
| 2701798 | 7/1978 | Germany . | |
| 3937214 | 5/1991 | Germany | 5/727 |
| 4436694 | 4/1996 | Germany . | |
| 407451 | 12/1963 | Switzerland . | |
| 1097078 | 6/1965 | United Kingdom . | |
| 8102384 | 9/1981 | WIPO | 5/727 |

*Primary Examiner*—Alexander Grosz
*Attorney, Agent, or Firm*—Robert W. Becker & Associates

[57] ABSTRACT

A mattress or mattress core is provided, and comprises a base member that is provided with at least two approximately cylindrical cavities that extend in a transverse direction of the mattress or mattress core. Approximately cylindrical inserts are adapted to be placed into the cavities. The inserts at least in part have different degrees of hardness.

10 Claims, 3 Drawing Sheets

MATTRESS

BACKGROUND OF THE INVENTION

The present invention relates to a mattress or a mattress core comprising a base member having cavities into which inserts can be placed.

Mattresses of this general type are known, for example, from DE 44 36 694 A1. This known mattress comprises a base member that on the support surface has three rectangular recesses that are filled with quadratic inserts, the hardness of which differs from that of the base member. In this way, the degree of hardness in various support areas of the mattress can be variable.

It is also known to manufacture mattresses from a plurality of mattress elements that have a differing degree of hardness and are detachably connected to one another. In this way, the hardness of the mattress elements can be assembled in conformity to the loads and can thus be adapted to individual requirements.

Unfortunately, in both cases the abutment edges between elements of different hardness can lead to uncomfortable shifting or bulges that adversely affect the resting comfort.

It is therefore an object of the present invention to provide a mattress of the aforementioned general type that productionwise is easy to manufacture, and, without adversely affecting the comfort, can be adapted to individual load requirements.

BRIEF DESCRIPTION OF THE DRAWINGS

This object, and other objects and advantages of the present invention, will appear more clearly from the following specification in conjunction with the accompanying schematic drawings, in which:

FIGS. 1 to 4*a* each show an exemplary embodiment of the inventive mattress or mattress core;

SUMMARY OF THE INVENTION

Figure 1:
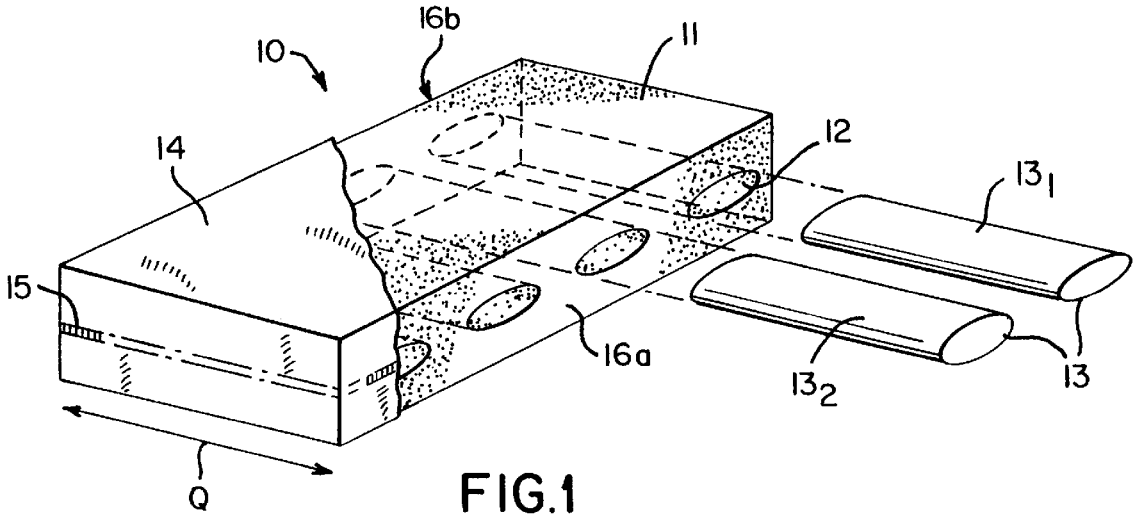

The mattress or mattress core of the present invention comprises a base member that is provided with at least two approximately cylindrical cavities that extend in a transverse direction of the mattress; approximately cylindrical inserts are adapted to be placed into the base member, wherein the inserts at least in part have different degrees of hardness.

The inventive mattress or mattress core is easy to manufacture. A base member having cylindrical, transversely directed elongated holes is produced, or the elongated holes are mechanically introduced after the manufacture of a solid base member. Corresponding inserts of varying hardness that fit in the elongated holes are manufactured. In this way, the user can select inserts of appropriate hardness to fit his needs and can place them into the elongated holes. The inserts can be exchanged for one another or in part for new inserts having a different hardness if the selected distribution of the degree of hardness along the mattress does not correspond to the individual loads.

In the context of the instant application cylindrical elongated holes and inserts are also intended to cover quadratic, parallelepipedal, oval, and polygonal cross-sections. The most straight forward shapes from the standpoint of manufacture are cylindrical components having a round cross-section. As a rule, the cross-sections of the elongated holes and of the inserts will have the same shape and dimension. However, it is also possible to provide different shapes. By combining elongated holes having round cross-sections with inserts having polygonal cross-sections it is, for example, possible to produce longitudinal gaps as ventilation channels. Where the cross-sections are the same, ventilation channels can also be provided by providing longitudinal grooves or other recessed areas on the periphery of either the inserts or the elongated holes.

The elongated holes and the inserts extend in the interior region of the mattress or mattress core, i.e. the base member, so that no detrimental recesses or bulges result at the support surface.

The present invention has the further advantage that if the customer makes a poor choice, upon alteration of the insert, or if wear occurs, individual inserts can be replaced by new inserts of different or the same hardness without having to cover the costs of an entire mattress.

The inventive base member can be flexibly utilized in that, for example with textile coverings, inlays, etc, it can be made into a mattress or designed directly as a mattress.

A productionwise very straightforward embodiment consists in making the cavities or elongated holes as bores that extend over the width of the base member or mattress. These bores are easy to produce, especially if the bores pass through the longitudinal sides of the base member.

Depending upon the design of the mattress, the bores are preferably uniformly distributed in one row, in several rows, or such that they are staggered or offset relative to one another in height over the length of the mattress. However, it is also possible to dispose the bores in an irregular manner in the base member with respect to the center of gravity thereof.

In order to facilitate replacement or exchange of the inserts in the base member, it is proposed to embody the base member as two parts, and in particular by means of a separation or division of the base member in a plane parallel to the support plane. A connection of the parts of the base member at a respective longitudinal edge permits the structural and inherent stability of the base member to be maintained, while at the same time providing a simple handling for the user when he or she wishes to introduce the inserts or to exchange them. Any coverings that are present are removed, the base member is opened or lifted up, and the inserts are distributed into the elongated holes.

The base member and the inserts are preferably made of polymeric material, such as polyurethane or latex. The use of natural products, such as wool, as well as their combination with synthetic materials, is also particularly suitable for the manufacture of the base member. The inserts can be designed in a great variety of ways depending upon need or desire. For example, they can be made of solid foam, latex or the like, or can also be hollow or inflatable.

Pursuant to a further specific embodiment of the present invention, a set of base members of different hardnesses, especially wear hardnesses, along with a palette of inserts of different degrees of hardness are proposed. This allows a good adaptation to different loads and to individual needs.

The inventive mattress is furthermore suitable for introducing heating elements, radio loud speakers, etc, into the mattress along with the inserts.

In addition, the inventive mattress is particularly suitable for hospital beds. By jointing or articulating the mattress in the region of differing compressive or wear hardnesses, the mattress can be easily bent or folded. Where large bend angles are involved a particularly soft insert can be used at the bend location or the insert can be entirely eliminated.

Further specific features of the present invention will be described in detail subsequently.

DESCRIPTION OF THE PREFERRED EMBODIMENTS

Referring now to the drawings in detail, FIG. 1 shows a mattress 10 that comprises a base member 11 of plastic, foam, polyurethane, latex or the like. The base member 11 is covered by a sleeve or cover 14 of wool, linen, cotton, mixed fibers, etc. By means of a closure means, especially a zipper 15, the cover 14 can be removed in order to provide access to the base member 11. It is also possible to integrate into the cover 14 known inlays or elements for winter or summer, materials that are suitable or effective for breathing, etc. The use of composite materials for all of the components of the mattress is similarly possible.

The base member 11 has the customary rectangular configuration; four passages or bores 12 extend through the interior of the base member 11 in the transverse direction Q of the mattress 10 (see the double arrow in FIG. 1). In the embodiment illustrated in FIG. 1, the bores 12 have an oval cross-sectional shape and extend from one longitudinal side 16*a* of the base member 11 to the opposite longitudinal side 16*b*.

Depending upon specific needs, inserts 13 having the same or different hardness are inserted into the bores 12. Thus, for example, at the head end of the mattress 10 a harder insert $\mathbf{13}_1$ can be provided followed by a softer insert $\mathbf{13}_2$ followed by a still softer insert and finally a harder insert at the foot end of the mattress. A base member equipped in this manner with inserts can be designed as a mattress or as the core of a mattress.

The base member 11 can be embodied in a variety of different ways. Instead of the bores 12 that extend all the way through, it is possible, as indicated in the embodiment of the mattress 20 illustrated in FIG. 2, to provide elongated holes 22 that end shortly before the longitudinal sides 26 of the base member 21, so that the longitudinal sides 26 form a closed surface. The inserts 23 are then received in the elongated holes 22.

Figure 2:
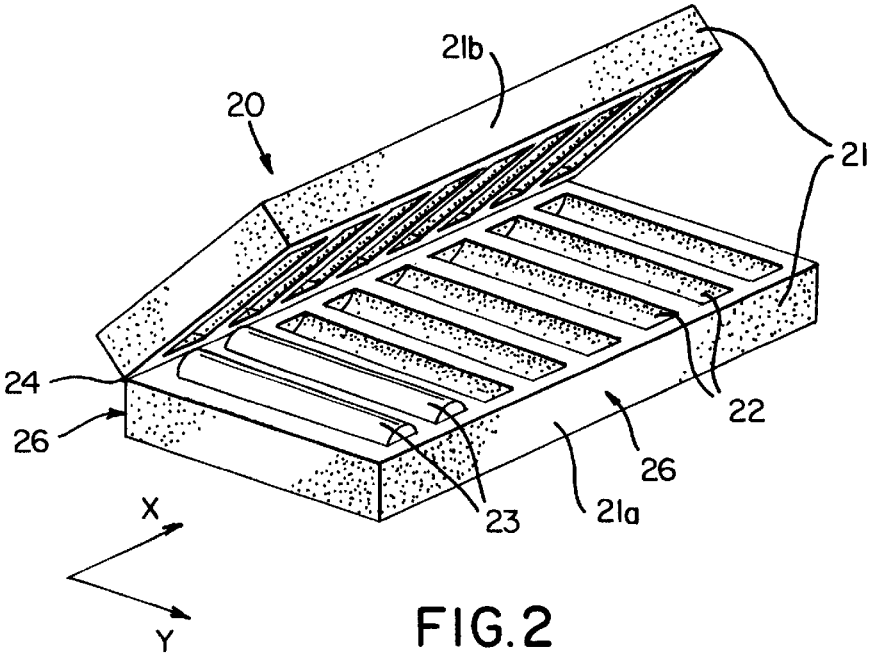
Figure 4A:
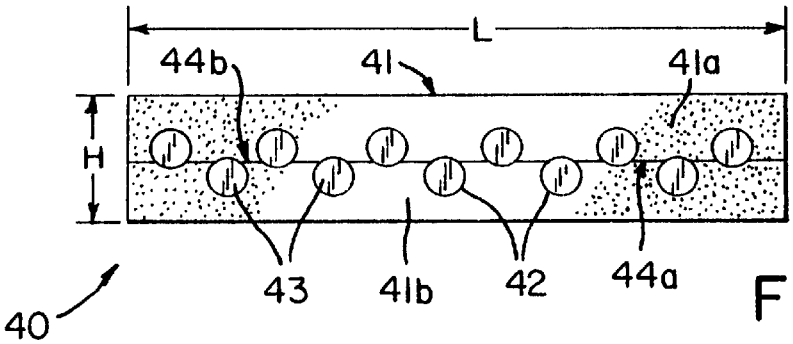
Figure 4B:
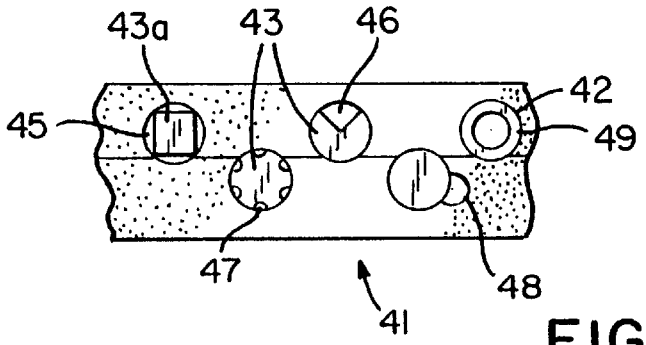
FIG. 4*b* is an enlarged view of a portion of the mattress of FIG. 4*a*.

In addition, the number and arrangement of the bores or elongated holes can be freely selected depending upon the material and degree of hardness of the individual components and depending upon the use. FIG. 2 illustrates an embodiment in which a plurality of elongated holes 22 are provided which in relation to the height H (see FIG. 4*a*) of the base member 21 are disposed in a central row. In the case of thick mattresses, two or more rows can be disposed above one another. A further possibility is illustrated in the embodiment of FIGS. 4*a* and 4*b*, where the bores 42 are staggered or offset relative to one another in both the longitudinal direction L and along the height H. The elongated holes and the inserts that are adapted thereto for a given mattress preferably have the same shape and dimension in order to allow exchange of the inserts for one another. None the less, different shapes and/or dimensions are possible in a mattress, whereby the elongated holes can be very precisely arranged and not necessarily at uniform spacing. Such embodiments have not been specifically illustrated. Instead of the oval inserts 13, it would be possible, for example, to provide three shallow, parallelepipedal inserts that are precisely disposed in correspondingly wide elongated holes in the shoulder, pelvic, and foot regions.

In addition, the shape of the elongated holes and of the inserts can be selected. In the simplest embodiment, both are cylindrical with a round cross-section, as illustrated for example in FIGS. 2 and 4. Instead of having a round cross-section, it would also be possible to use rectangular, oval, polygonal, or other cross-sections. The selection of elongated holes 42 with round cross-sections and inserts 43*a* with polygonal cross-sections, as illustrated in the left side of FIG. 4*b*, can also be advantageous. The gaps 45 that remain between the insert 43*a* and the elongated hole 42 can represent suitable ventilation channels.

Ventilation channels can also be provided by means of longitudinal notches or grooves 46, 47 in the inserts 43, or recessed areas 48 in the base member 41. In FIG. 4*b*, the ventilation channels 46 and 48 are exaggerated in size to facilitate illustration.

Further variations in the configuration of the inserts include providing them either as solid cylinders, such as the inserts 13, 23, 33, 43 and 43*a*, or as hollow bodies. The hollow inserts 49 (FIG. 4*b*) can either be open tubes or can be provided with one or more closed hollow chambers. In both latter cases, it is also possible to have inflatable variations that are provided with valves, so that the user can adjust the degree of hardness suitable for him by inflating or letting air out of the inserts.

FIG. 2 shows an embodiment where the base member 21 is divided along a plane xy parallel to the support plane into two base member parts 21*a*, 21*b* in order to facilitate placement of the inserts 23. With a closed embodiment such as that shown in FIG. 1 additional auxiliary aids, such as guide tubes, maybe be necessary due to high material friction in order to be able to introduce the inserts into the base member. In contrast, a separable base member 21, or one that can be opened about a hinge axis 24 as in FIG. 2, requires neither special embodiments of the individual components 21, 23, nor other auxiliary aids in order to be able to place the inserts 23 into the elongated holes 22 provided in the base member.

Figure 3:
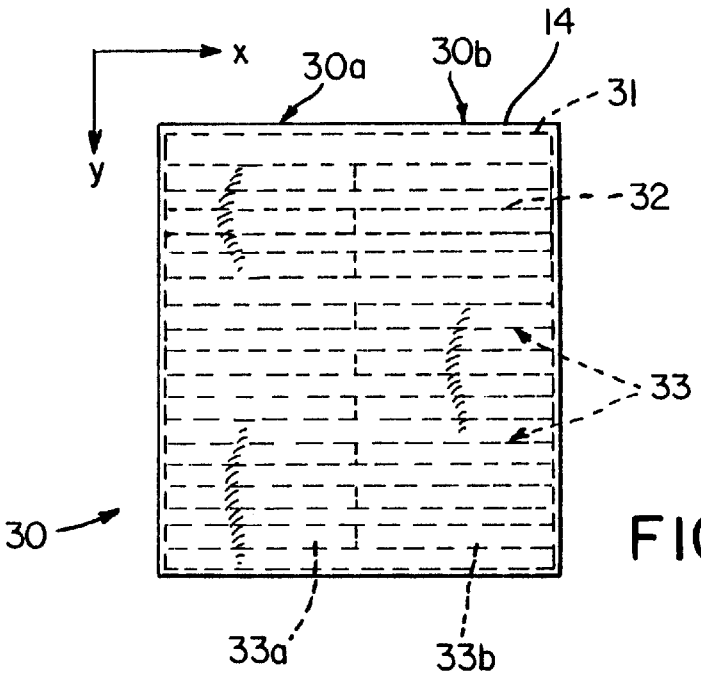

FIG. 3 shows a plan view of a dual mattress 30. In order to be able to take into account the requirements for different loads in the two sides 30*a*, 30*b* of the mattress 30, the inserts 33 for each bore 32 of the base member 31 have two parts 33*a*, 33*b* so that in each case different degrees of hardness can be adjusted for the left and for the right user.

FIG. 4*a* shows a longitudinal side view of a base member 41 that is in two parts or that can be opened. The base member 41 comprises an upper part 41*a* and a lower 41*b*, with the bores 42 being staggered or offset relative to one another in such a way that they are open at the planes of separation 44*a*, 44*b* of the base members 41*a*, 41*b*.

The inventive configuration is suitable not only for simple mattresses where, for example, the base member together with the inserts forms the mattress, but also for multi-component mattresses where the base member forms the mattress core. The inserts can additionally be utilized to fulfill further functions, for example as a heating component, to form ventilation channels, to form bendable locations for use, for example, on hospital beds, etc.

The present invention can also be realized by providing a set of base members of different hardnesses and inserts with a wide range of hardnesses in order in this way to enable the user as extensive as possible an adaptation to his or her needs.

The mattresses or mattress cores of the present invention have a great many uses. For example, they can be used not only in conjunction with bedsteads but also with armchairs, sofas, chairs, vehicle or aircraft seats, lawn or deck chairs, beds, and all furniture that is used for sleeping, sitting, or lying down. Involved are mattresses as such, mattress cores, cushions, pads, bolsters, etc.

Figure 5A:
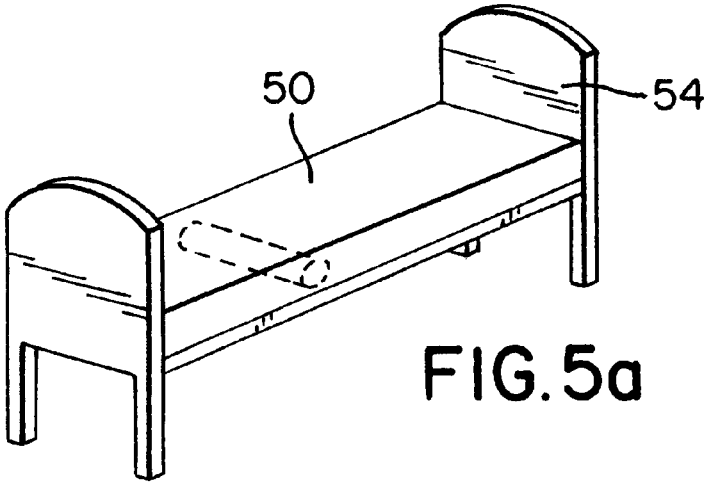
FIGS. 5*a*–5*c* illustrate exemplary applications for the inventive mattress or mattress core.
Figure 5B:
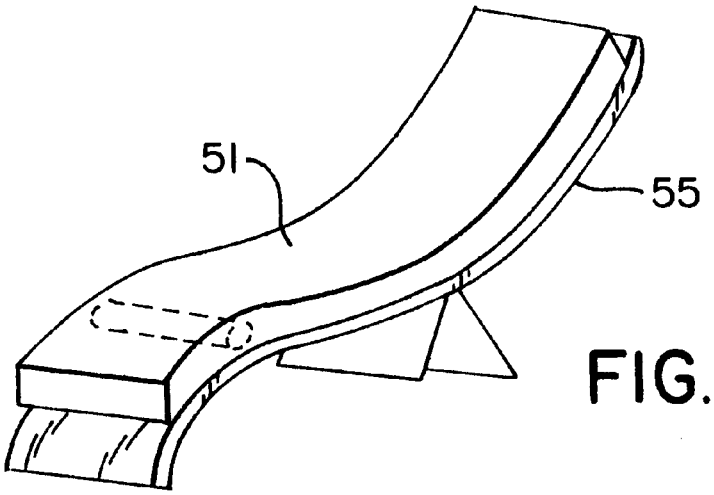
Figure 5C:
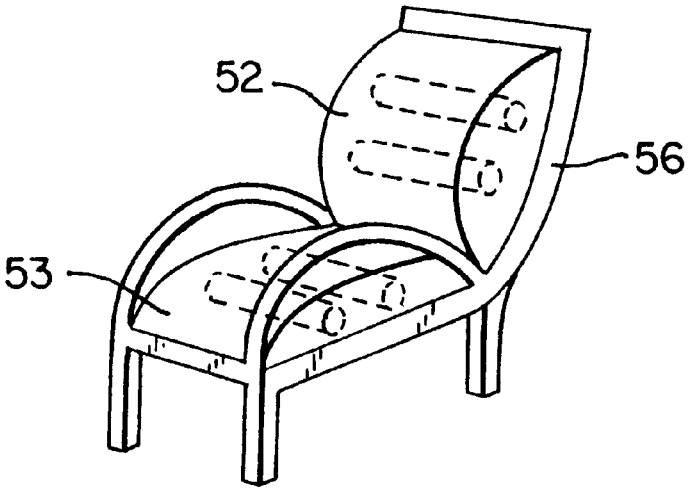

Exemplary applications are illustrated in FIGS. 5*a*–5*c*. In particular, FIG. 5*a* shows a rectangular mattress 50 for a bedstead 54. FIG. 5*b* again shows a rectangular mattress as a pad or cushion 51 for a deck or lawn chair 55. FIG. 5*c* shows an armchair 56 having two mattresses embodied as cushions 52 and 53. These mattresses, cushions or pads 50–53 are provided with at least two inserts and can be embodied in conformity with the previously described embodiments of FIGS. 1 to 4. To simply illustration, only one or two of such inserts are illustrated in FIGS. 5*a*–5*c*. However, it is to be understood that depending upon need and the form of the mattresses, two up to a plurality of inserts can be contained in the mattresses. For quadratic or cubic mattress portions or pads, it is possible, for example, to provide two to four inserts in one layer or, in conformity with the embodiment of FIG. 4, in each layer.

The specification incorporates by reference the disclosure of German priority document 198 12 382.5 of Mar. 22, 1998.

The present invention is, of course, in no way restricted to the specific disclosure of the specification and drawings, but also encompasses any modifications within the scope of the appended claims.

What is claimed:

1. A mattress or mattress core, comprising:

a base member that is provided with at least two approximately cylindrical cavities that extend in a transverse direction of said mattress or mattress core, wherein said base member is divided into two base member parts in a plane parallel to a support plane of said base member, and wherein said two base member parts are connected to one another along a respective longitudinal edge such that said base member parts are pivotable relative to one another along said longitudinal edges; and approximately cylindrical inserts that are adapted to be placed into said cavities, wherein said inserts at least in part have different degrees of hardness.

2. A mattress or mattress core according to claim 1, wherein for overly wide mattresses, including dual mattresses, said inserts are embodied in two parts, in a longitudinal direction thereof.

3. A mattress or mattress core according to claim 1, wherein at least one of said inserts has elastic properties that are different from an elastic property of said base member.

4. A mattress or mattress core according to claim 1, wherein said inserts are provided with longitudinal grooves that serve as ventilation channels.

5. A mattress or mattress core according to claim 1, wherein said base member, adjacent said cavities thereof, is provided with recessed areas in the form of ventilation channels.

6. A mattress or mattress core according to claim 1, wherein said base member and said inserts are made of polymeric material.

7. A mattress or mattress core according to claim 1, wherein said inserts are in the form of hollow bodies.

8. A mattress or mattress core according to claim 7, wherein said hollow bodies are inflatable.

9. A mattress or mattress core according to claim 1, wherein said mattress or mattress core is a single or dual mattress for a bedstead.

10. A mattress or mattress core according to claim 1, wherein said mattress or mattress core is a cushion or pad for a chair, armchair, vehicle seat, sofa, lawn or deck chair, bed, or the like.

* * * * *